United States Patent [19]

Donivan et al.

[11] Patent Number: 5,005,050

[45] Date of Patent: Apr. 2, 1991

[54] CONTROL OF TONER PARTICLE CHARGE

[75] Inventors: Lawrence J. Donivan; Joseph F. Laukaitis, both of Rochester, N.Y.

[73] Assignee: Eastman Kodak Company, Rochester, N.Y.

[21] Appl. No.: 366,728

[22] Filed: Jun. 15, 1989

[51] Int. Cl.[5] ..... G03G 15/08

[52] U.S. Cl. ..... 355/208; 355/246

[58] Field of Search ..... 355/208, 246; 361/225

[56] References Cited

U.S. PATENT DOCUMENTS

| | | | |
|---|---|---|---|
| 3,324,291 | 6/1967 | Hudson . | |
| 3,339,069 | 8/1967 | Hayne et al. . | |
| 3,668,008 | 6/1972 | Severynse . | |
| 3,687,539 | 8/1972 | Furuichi . | |
| 3,743,540 | 7/1973 | Hudson . | |
| 3,777,158 | 12/1973 | Kamogawa et al. . | |
| 3,936,184 | 2/1976 | Tanaka et al. . | |
| 4,026,643 | 5/1977 | Bergman | 355/246 |
| 4,093,368 | 6/1976 | Nishikawa . | |

FOREIGN PATENT DOCUMENTS

| | | | |
|---|---|---|---|
| 59-17569 | 1/1984 | Japan | 355/246 |
| 62-164068 | 7/1987 | Japan . | |

*Primary Examiner*—Joan H. Pendegrass

*Attorney, Agent, or Firm*—Milton S. Sales

[57] ABSTRACT

Apparatus is disclosed for controlling the charge-to-mass ratio of developed electrostatic images. An electrostatographic reproduction machine for developing an electrostatic latent image with charge toner particles produces a control signal characteristic of the ratio of toner partical electrostatic charge to the toner particle mass, and the charge-to-mass ratio is adjusted in response to the control signal. The control signal is produced by comparing the ratio of toner particle electrostatic charge to the toner particle mass of a toned test patch. The ratio is adjusted by means of ions directed to the toner particles. The ion source may be capable of producing positive and negative ions, and may be a corona charger.

6 Claims, 3 Drawing Sheets

CONTROL OF TONER PARTICLE CHARGE

BACKGROUND OF THE INVENTION

1. Technical Field

This invention relates generally to electrostatographic reproduction machines, and more particularly to the control of the ratio of toner particle electrostatic charge to toner particle mass (the charge-to-mass ratio) in such machines.

2. Background Art

During use of electrostatographic reproduction machines, larger toner particles develop easier than smaller particles, resulting in the decrease of average toner particle size and greater charge-to-mass ratios. This results in a tendency toward decreased toner density for a given charge difference between the toner particles and the electrostatic image.

Further, low charge-to-mass ratios result in excessive toner dusting. Severe dusting can result in high background levels on reproductions and in contamination of mirrors, chargers, image receivers, etc.

SUMMARY OF INVENTION

It is an object of the present invention to provide novel means for controlling the charge-to-mass ratio of developed electrostatic images.

It is another object of the present invention to provide an electrostatographic reproduction machine having means for developing an electrostatic latent image with charged toner particles, wherein means are provided for producing a control signal characteristic of the ratio toner particle electrostatic charge to the toner particle mass, and the charge-to-mass ratio is adjusted in response to the control signal.

In accordance with a preferred embodiment of the present invention, a control signal is produced by computing the ratio of toner particle electrostatic charge to the toner particle mass of a toned test patch. The ratio is adjusted by means of ions directed over the developed image. The ion source may be capable of producing positive and negative ions, and may be a corona charger.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DISCLOSURE OF INVENTION

The present invention is described below in the environment of an electrophotographic copier. Although this invention is suitable for use with such machines, it also can be used with other types of electrostatographic copiers and printers.

Figure 1:
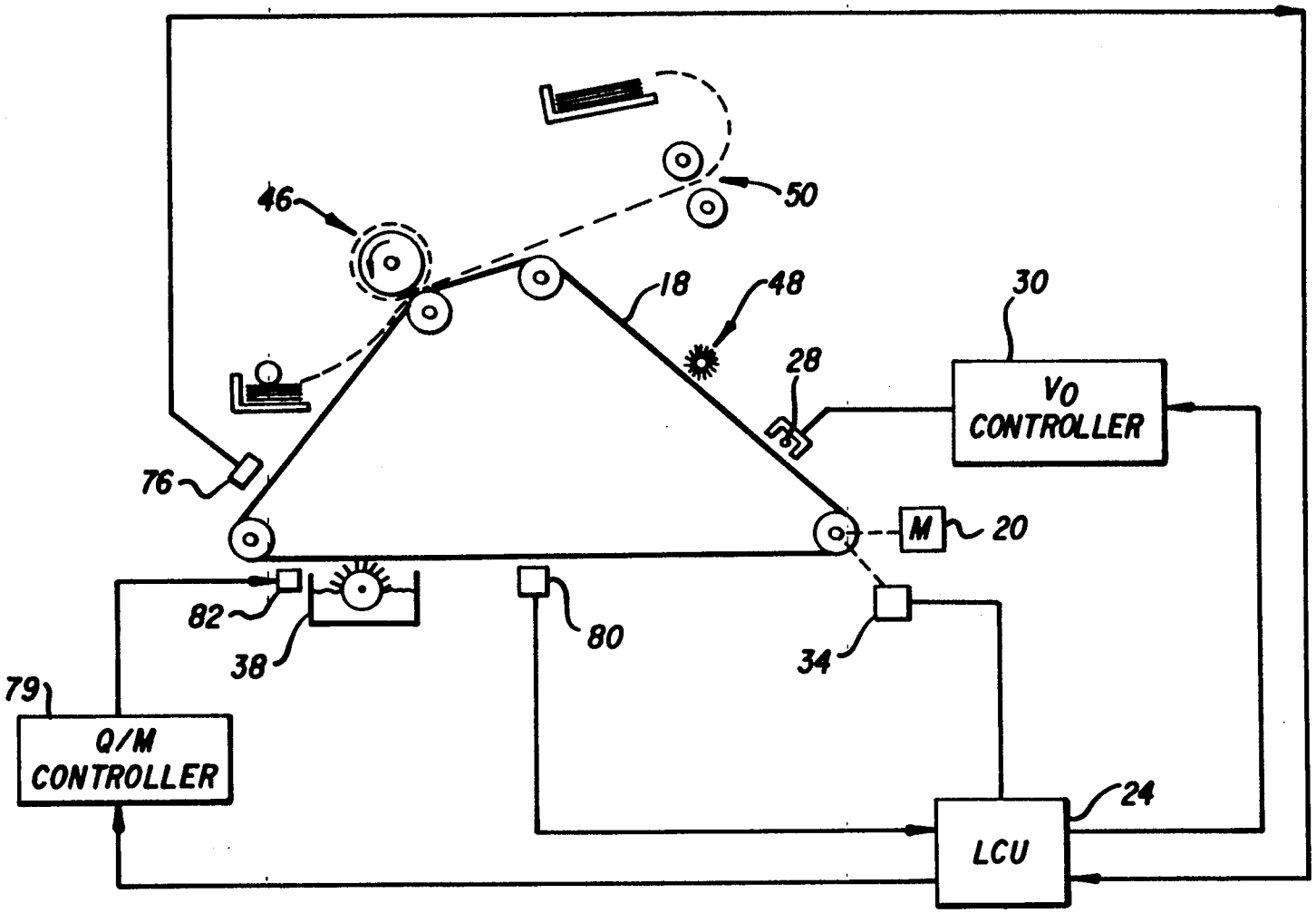
FIG. 1 is a schematic showing a side elevational view of an electrostatographic machine in accordance with a preferred embodiment of the invention.

Referring to FIG. 1, a moving transfer member such as photoconductive belt 18 is driven by a motor 20 past a series of work stations of the printer. A logic and control unit (LCU) 24, which has a digital computer, has a stored program for sequentially actuating the work stations. Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

For a complete description of the work stations, see commonly assigned U.S. Pat. No. 3,914,046. Briefly, a charging station 28 sensitizes belt 18 by applying a uniform electrostatic charge of predetermined primary voltage to the surface of the belt. At an exposure station 34, projected light from a write head dissipates the electrostatic charge on the photoconductive belt to form a latent image of a document to be copied or printed.

Travel of belt 18 brings the areas bearing the latent images to a development station 38. The development station has one (more if color) magnetic brush in juxtaposition to, but spaced from, the travel path of the belt. Magnetic brush development stations are well known. For example, see U.S. Pat. No. 4,473,029 to Fritz et al and 4,546,060 to Miskinis et al.

LCU 24 selectively activates the development station in relation to the passage of the image areas containing latent images to selectively bring the magnetic brush into operation. The charged toner particles of the magnetic brush are attracted to the oppositely imagewise charge pattern of the latent image to develop the pattern.

A transfer station 46 and a cleaning station 48 are both fully described in commonly assigned U.S. patent application Ser. No. 809,546, filed Dec. 16, 1985. After transfer of the unfixed toner images to a receiver sheet, such sheet is transported to a fuser station 50 where the image is fixed.

Figure 2:
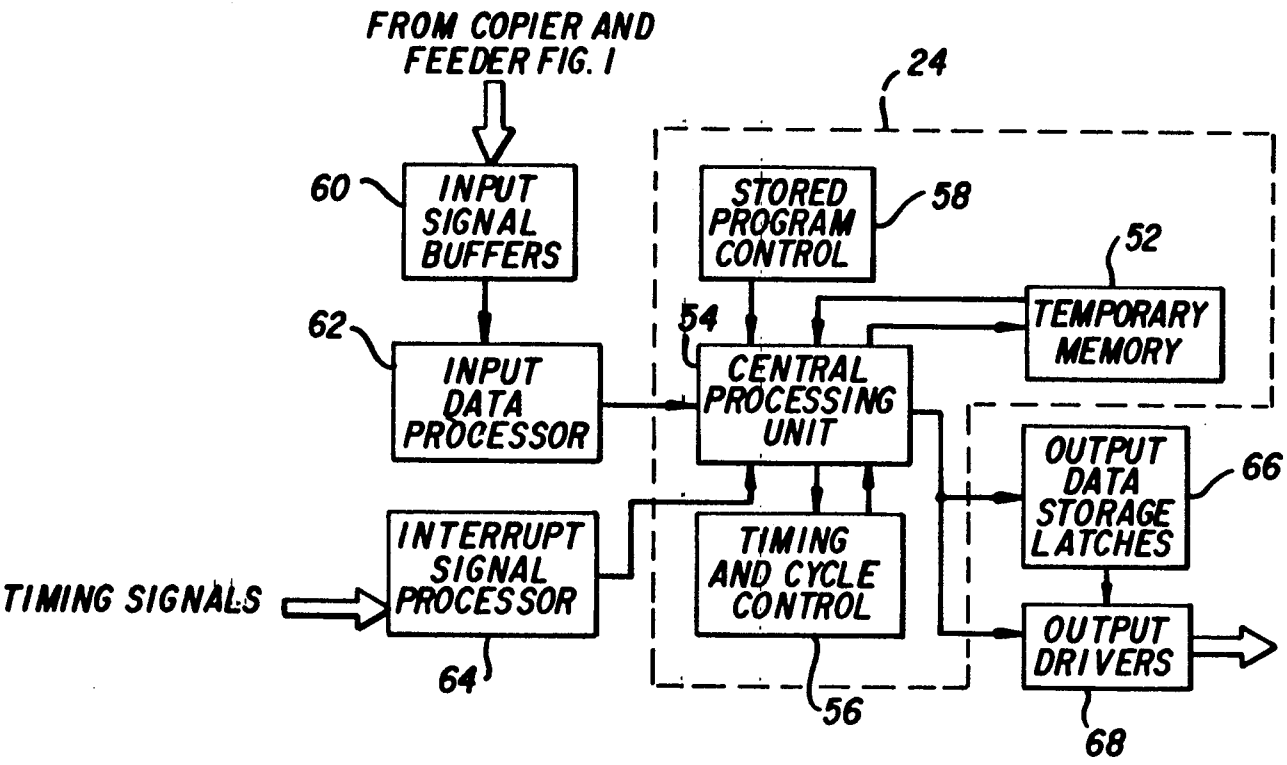
FIG. 2 is a block diagram of the logic and control unit shown in FIG. 1.

Referring to FIG. 2, a block diagram of a typical LCU 24 is shown. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Process control strategies generally utilize various sensors to provide real-time control of the electrostatographic process and to provide "constant" image quality output from the user's perspective.

Figure 3:
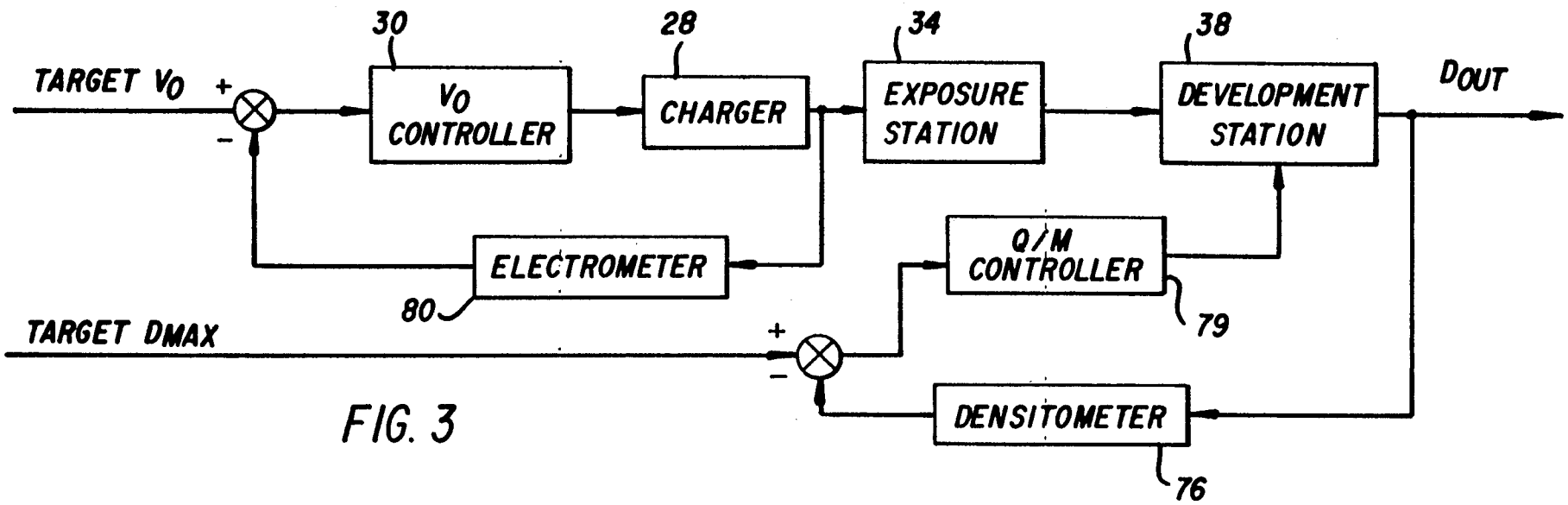
FIG. 3 is a diagram of the process for deriving a charge-to-mass ratio control signal for the electrostatographic machine of FIG. 1.

One such sensor may be a densitometer 76 (FIGS. 1 and 3) to monitor development of test patches in non-image areas of photoconductive belt 18, as is well known in the art. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal "ΔD" representative of an estimate of toned density. The bare patch signal is represented in FIG. 3 as coming from densitometer 76', which may be the same as densitometer 76 or another densitometer. Using stored tables 86 or equations in the microprocessor of LCU 24, the mass "M" of toner in a test patch can be computed as set forth in commonly assigned co-pending U.S. patent application Ser. No. 68,382 filed July 1, 1987.

A pair of electrometer probes 80 and 82 measure the potential of the charged surface of belt 18 before and after development, respectively. The outputs of the electrometers are compared at a difference network 84, and the difference "ΔQ" between the signals is proportional to the amount of charge deposited on the belt due to movement of toner particles from the development station to the test patch, also described in.

Once the deposited charge ΔQ and the mass M of the toner in a test patch have been computed, obtaining the charge-to-mass ratio is found by means of a dividing network 88. The charge-to-mass ratio is compared to a target value by a comparator 90. The target value is determinable by ambient conditions such as relative humidity and temperature. Any deviation from the target value is used by charge-to-mass controller 91 to adjust the toner charge-to-mass ratio for consistent development performance and minimal toner dusting.

For example, normally when temperature increases or the relative humidity decreases, the charge-to-mass ratio increases and the density of the test patch decreases. Charge-to-mass controller 91 gives a command to adjust the charge to compensate for this change.

Figure 4:
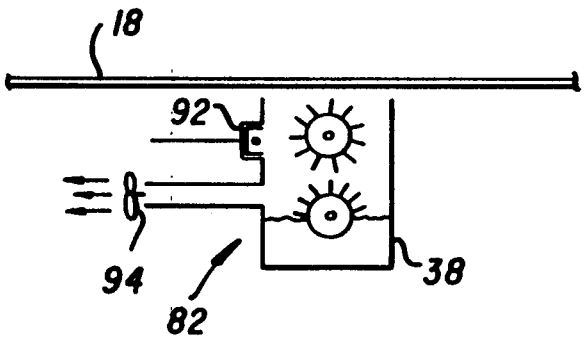
FIG. 4 is a schematic showing apparatus for applying ionized air to control toner charge.

FIG. 4 schematically illustrates the preferred apparatus for controlling the toner particle charge. An ion generator may take several forms. In the illustrated embodiment, an ion corona generator 92 produces an ion cloud which is drawn into the development station by a blower 94, transferring the ion charge to the toner particles. Corona wire 92 or other ion generator is preferably bi-polar so that either positive or negative ions can be generated to raise or lower the charge-to-mass ratio of positive toner, or to lower or raise the charge-to-mass ratio of negative toner, respectively.

During experimentation, it has been found that the ions can be migrated over considerable distances by the air stream generated by a blower 94. Longer distances gives the ions opportunity to recombine and loose efficiency, but eleven inches between the ion source and the development station have not proven to be excessive during the experiments.

The invention has been described in detail with particular reference to preferred embodiments thereof, but it will be understood that variations and modifications can be effected within the spirit and scope of the invention.

What is claimed is:

1. In an electrostatographic reproduction machine having means for developing an electrostatic latent image with charged toner particles, the improvement comprising:

means for producing a control signal characteristic of the ratio of toner particle electrostatic charge to the toner particle mass; and means responsive to said control signal for adjusting said ratio, said adjusting means including a source of ions and means for directing the ions to the toner particles.

2. The improvement as defined in claim 1 wherein said signal producing means comprises:

means for producing a toned test patch; and means, responsive to the ratio of toner particle electrostatic charge to the toner particle mass in said test patch for generating said control signal.

3. The improvement as defined in claim 1 wherein said source of ions is capable of producing positive and negative ions.

4. The improvement as defined in claim 1 wherein said source of ions is a corona charger.

5. The improvement as defined in claim 1 wherein said ratio adjusting means comprises:

means for comparing said control signal to a reference value, said reference value varying with ambient conditions.

6. The improvement as defined in claim 5 wherein said ambient conditions include relative humidity and temperature.

* * * * *

UNITED STATES PATENT AND TRADEMARK OFFICE

CERTIFICATE OF CORRECTION

PATENT NO. : 5,005,050

DATED : April 2, 1991

INVENTOR(S) : Lawrence J. Donivan & Joseph F. Laukaitis

It is certified that error appears in the above-identified patent and that said Letters Patent is hereby corrected as shown below:

IN THE DRAWINGS: Sheet 1 containing FIG. 1 should be as follows:

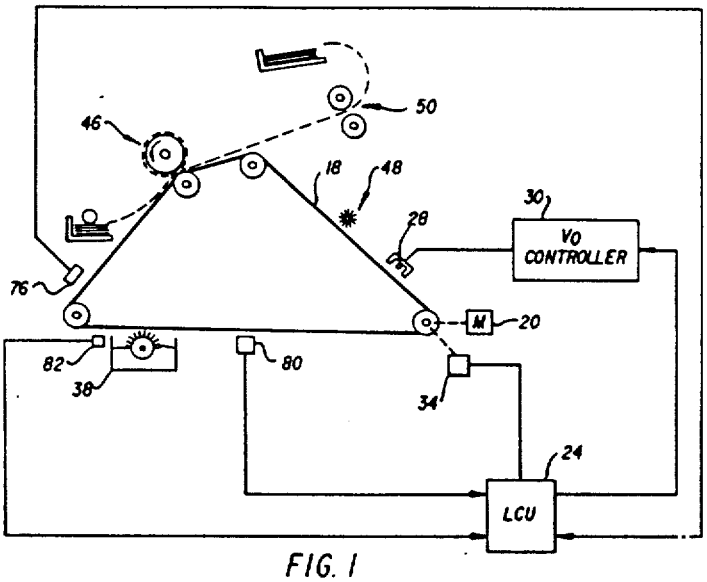

FIG. 1

UNITED STATES PATENT AND TRADEMARK OFFICE

CERTIFICATE OF CORRECTION

PATENT NO. : 5,005,050 Page 2 of 2

DATED : April 2, 1991

INVENTOR(S) : Lawrence J. Donivan & Joseph F. Laukaitis

It is certified that error appears in the above-identified patent and that said Letters Patent is hereby corrected as shown below:

IN THE DRAWINGS: Sheet 3 containing FIGS. 3 containing FIGS. 3 and 4 should be as follows:

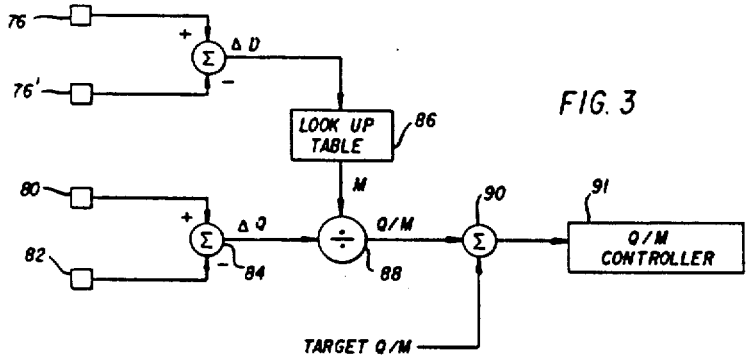

FIG. 3

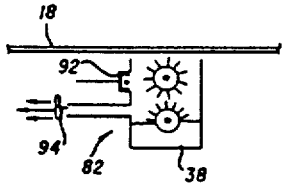

FIG. 4

Signed and Sealed this

Fifth Day of May, 1992

*Attest:*

DOUGLAS B. COMER

*Attesting Officer*

*Acting Commissioner of Patents and Trademarks*